US011571736B2

(12) United States Patent
Badent et al.

(10) Patent No.: US 11,571,736 B2
(45) Date of Patent: Feb. 7, 2023

(54) C-SHAPED FRAME AND DEVICE FOR COLD JOINING

(71) Applicant: TOX PRESSOTECHNIK GMBH & CO. KG, Weingarten (DE)

(72) Inventors: Michael Badent, Weingarten (DE); Florian Schneider, Weingarten (DE); Sascha Sommer, Sigmaringendorf (DE); Frederik Freudling, Tettnang (DE)

(73) Assignee: Tox Pressotechnik GmbH & Co. KG, Weingarten (DE)

( * ) Notice: Subject to any disclaimer, the term of this patent is extended or adjusted under 35 U.S.C. 154(b) by 0 days.

(21) Appl. No.: 17/188,175

(22) Filed: Mar. 1, 2021

(65) Prior Publication Data

US 2021/0220902 A1 Jul. 22, 2021

Related U.S. Application Data

(63) Continuation of application No. PCT/EP2019/070149, filed on Jul. 26, 2019.

(30) Foreign Application Priority Data

Sep. 4, 2018 (DE) ..... 10 2018 121 518.5

(51) Int. Cl.
*B21J 15/30* (2006.01)
*B21J 15/10* (2006.01)

(52) U.S. Cl.
CPC ..... *B21J 15/30* (2013.01); *B21J 15/10* (2013.01)

(58) Field of Classification Search
CPC ..... Y10T 29/53852; Y10T 29/53826; Y10T 29/5377–53774; B21J 15/10;
(Continued)

(56) References Cited

U.S. PATENT DOCUMENTS 718,365 A * 1/1903 Martin ..... B21J 15/20 60/560
748,816 A * 1/1904 Terry ..... B21J 15/10 29/243.54

(Continued)

FOREIGN PATENT DOCUMENTS

CN 104148572 A 11/2014
DE 10 2015 104 149 A1 6/2016

(Continued)

OTHER PUBLICATIONS

Arora et al., "Design of Beams (Flexural Members) (Part 5 of AISC/LRFD)", available on web Jan. 27, 2018 (Year: 2018).*

(Continued)

*Primary Examiner* — Matthew P Travers
(74) *Attorney, Agent, or Firm* — Burr Patent Law, PLLC

(57) ABSTRACT

A C-shaped frame for a cold-joining tool has two leg sections spaced apart from one another and a connection section. A punch unit and a die unit are provided opposite one another to define a tool axis. The C-shaped frame has a first surface side and a second surface side. An outer contour of the C-shaped frame is determined by an outer edge of the C-shaped frame in the transition between the two surface sides. The C-shaped frame includes a reinforcing section provided on the outer edge along the outer contour of the C-shaped frame. There are multiple portions of the reinforcing section, each with an associated thickness dimension of the portion, over a profile of the reinforcing section as seen along the outer edge. The extent of the respective portions along the outer edge and parallel to a surface side is in each case at least 30 millimetres.

15 Claims, 3 Drawing Sheets

(58) Field of Classification Search
CPC ..... B21J 15/105; B21J 15/142; B21J 15/20; B21J 15/26; B21J 15/30; E04C 2003/0452
See application file for complete search history.

(56) References Cited

U.S. PATENT DOCUMENTS

| | | | | |
|---|---|---|---|---|
| 1,813,118 | A * | 7/1931 | Edwards | E04C 3/06 52/837 |
| 2,372,721 | A * | 4/1945 | Harcourt | B21J 15/22 72/453.19 |
| 4,720,897 | A | 1/1988 | Orrell et al. | |
| 5,898,985 | A * | 5/1999 | Villarreal | B25B 27/062 29/257 |
| 2004/0217144 | A1* | 11/2004 | Matthews | B21J 15/28 227/119 |
| 2008/0276444 | A1 | 11/2008 | Condliff | |
| 2008/0277953 | A1* | 11/2008 | Condliff | B21J 15/10 294/104 |
| 2012/0186191 | A1* | 7/2012 | Okada | E04C 3/06 52/837 |
| 2013/0263433 | A1 | 10/2013 | Stoian | |
| 2015/0096244 | A1* | 4/2015 | Richards | E04B 1/98 52/167.1 |
| 2015/0101175 | A1* | 4/2015 | Xi | B21J 15/28 29/525.06 |
| 2016/0167111 | A1 | 6/2016 | Park et al. | |
| 2016/0325341 | A1* | 11/2016 | Gostylla | B21J 15/025 |
| 2017/0001236 | A1* | 1/2017 | Badent | B21J 15/36 |
| 2018/0333769 | A1 | 11/2018 | Rehling | |
| 2020/0308832 | A1* | 10/2020 | Han | E04C 3/06 |
| 2020/0346277 | A1* | 11/2020 | Gostylla | B21J 15/32 |

FOREIGN PATENT DOCUMENTS

| | | | |
|---|---|---|---|
| DE | 10 2018 200 339 | A1 | 7/2018 |
| EP | 3 403 741 | A1 | 11/2018 |
| WO | 2018/078006 | A1 | 5/2018 |

OTHER PUBLICATIONS

Gruppe Böllhoff, "Stanzniettechnik für den modemen Mischbau—RIVSET Automation H," Jan. 1, 2016, https://media.boellhoff.com/files/pdf1/rivset-automation-h-de-6705.pdf, retrieved Jan. 10, 2020.
Gruppe Böllhoff, "Das beste aus zwei Welten für den modemen Mischbau—RIVSET Automation EH," Jan. 1, 2018, https://media.boellhoff.com/files/pdf1/rivset-automation-eh-de-6708.pdf, retrieved Jan. 10, 2020.
Wilheim Böllhoff GmbH & Co. Kg, "Stanznietsysteme—RIVSET Bollhoff—Inhaltübersicht" ("Self Pierce Riveting Systems for Perfect Joints"), Jan. 10, 2020, https://boellhoff.com/de-de/produkte-und-dienstleistungen/montagetechnik/stanznietsysteme-rivset.php, retrieved Jan. 10, 2020.
German Search Report (Application No. 10 2018 121 518.5) dated May 28, 2019.
International Search Report and Written Opinion (Application No. PCT/EP2019/070149) dated Jan. 17, 2020.
English translation of International Preliminary Report on Patentability (Chapter I) (Application No. PCT/EP2019/070149) dated Mar. 9, 2021, 8 pages.

* cited by examiner

C-SHAPED FRAME AND DEVICE FOR COLD JOINING

CROSS REFERENCE TO RELATED APPLICATIONS

This application is a continuation of International Application No. PCT/EP2019/070149 filed Jul. 26, 2019, which designated the United States, and claims the benefit under 35 USC § 119(a)-(d) of German Application No. 10 2018 121 518.5 filed Sep. 4, 2018, the entireties of which are incorporated herein by reference.

FIELD OF THE INVENTION

The present invention relates to a C-shaped frame and device for cold joining.

BACKGROUND OF THE INVENTION

Devices and tools for cold forming or punching workpiece sections, in particular, made of a steel material, such as, for example, tools for riveting or solid punch riveting or semi-tubular punch riveting, clinching, pressing-in or embossing, have to satisfy different requirements. Such tools regularly have tongs or a tool clip or a "C-shaped frame" or C-clip, which carries the appropriate tool elements which come to act on the workpiece.

For the design of the tools or the C-shaped frames, the operations to be managed with the tools have to form the basis, wherein the processes are defined exactly and short cycle times with high process safety is desired. The tools should, in particular, have low weights with the maximum load-bearing capacity and, furthermore, advantageously be producible economically. In order to achieve these targets, complex relationships have to be taken into account in order to be able to provide modern tools.

Because of a high level of automation, C-shaped frames are frequently used in a mobile manner on industrial robots as their tool.

SUMMARY OF THE INVENTION

The object of the present invention is to provide a device and a tool of the type mentioned at the beginning, wherein the device is suitable for different requirement profiles and can be used variably and process-safely.

The present invention is based on a C-shaped frame for a device for cold joining, in particular, for a cold-joining tool, wherein the C-shaped frame has two leg sections spaced apart from one another and a connection section, wherein a punch unit of the device can be provided at a free end of the first leg section, and a die unit of the device can be provided at a free end of a second leg section, so that, when ready to use, the punch unit and the die unit are located opposite one another and predefine a tool axis, and wherein ends of the leg sections that face away from the free ends are connected to one another via the connection section, wherein the C-shaped frame has a first surface side and a second surface side opposite the first surface side, wherein an outer contour of the C-shaped frame is determined by an outer edge of the C-shaped frame in the transition between the two surface sides.

The workpiece that can be processed with the device can be positioned between the punch unit and the opposite die unit. A drive unit can be coupled to the punch unit in such a way that a punch of the punch unit can be driven to move along a joining axis of the device. The joining axis is defined by the device which, in particular, as a rule coincides with a central longitudinal axis of the punch. The drive unit for the punch is, in particular, an electric drive or a hydraulic or pneumatic or hydro-pneumatic drive with a linearly driven movable drive plunger, which can be coupled to the punch. It is also possible to imagine that the drive unit can be coupled to the die unit, that the die can be driven to move along the joining axis of the device. It is also conceivable that the drive unit can be coupled to the punch unit and to the die unit, that the punch and the die can be driven to move along the joining axis of the device.

The device has a preferably programmable higher-order control unit for controlling the operation of the device. The control unit comprises a computer or computer unit together with software and communicates with different components such as sensor, measurement, actuating and/or drive units of the punch unit and the die unit.

The core of the present invention is that the C-shaped frame comprises a reinforcing section, which is provided on the outer edge along the outer contour of the C-shaped frame, wherein there are multiple portions of the reinforcing section each having an associated thickness dimension of the portion over a profile of the reinforcing section, as seen along the outer edge, wherein an extent of the respective portions along the outer edge and parallel to a surface side is in each case at least 30 millimeters. Preferably, at least two portions with a different thickness dimension are provided. The reinforcing section has an increased thickness or a greater material thickness or a material accumulation as compared with a generally uniform minimum thickness of the remaining regions of the C-shaped frame, which are in particular plate-like or part of a common plate.

The reinforcing section forms, for example, an at least virtually closed loop along the outer edge. Therefore, the structure of the C-shaped frame is optimized. Firstly, advantageous production of the C-shaped frame, in particular, an automated production operation with known methods using familiar materials for the C-shaped frame, such as, for example, steel materials, is therefore possible, and, secondly, a comparatively high mechanical stability or a high stiffness with the lowest possible deformation and minimized material use can be implemented.

With the C-shaped frame according to the present invention, a maximum permissible oblique positioning or a maximum permissible radial offset of the tools on the C-shaped frame as a result of bending of the C-shaped frame can be maintained or undershot in a practical manner. As a result, undesired transverse forces on the tools can be avoided. In addition, when the C-shaped frame is not operating, maximum permissible tool offsets and angular mispositioning as a result of a spatial position-dependent deformation of the C-shaped frame because of its own weight and the action of the force of gravity of the tool components mounted on the frame are maintained.

In particular, further advantages during the useful use of the C-shaped frame can be achieved, in particular, since the weight and external dimensions of the C-shaped frame can be kept comparatively low, even with highly-loaded C-shaped frames. This results in a series of further advantages which, for example, also relate to the process management and the energy consumption of the operation that can be carried out with the associated tool. The C-shaped frame according to the present invention, which is lighter as compared with known C-shaped frames in plate form, can be operated with weaker and therefore more economical industrial robots, and lower operating costs arise, since a lower energy consumption is possible as a result of the acceleration and deceleration of the C-shaped frame according to the present invention having a lower mass.

The C-shaped frame according to the present invention advantageously absorbs comparatively high pressing forces, despite a reduced overall weight.

The C-shaped frame according to the present invention additionally makes it possible to influence the kinematics of the bending of the C-shaped frame, which cannot be avoided completely in practice, in such a way that the resultant spatial positional change of the tool parts relative to the joining and tool axis when working and under load results in the predominantly coaxial direction. In this direction, deformation can be tolerated to a greater extent, since this can be compensated with a comparatively less negative, longer working stroke of the working punch.

Preferably, the C-shaped frame is in one piece, in particular, made of a steel material. Preferably, the C-shaped frame is produced from a standard starting material such as, for example, a flat plate-like material blank, for example, produced from a material plate or steel plate, for example, machined from a steel blank by means of material-removing processing of the steel blank. The connection section and the first and second beam sections are accordingly advantageously formed in one piece.

The region of the free ends of the first leg section and/or the second leg section is at least approximately trapezoidal or not triangular in a top view of the respective surface side, or the free ends are, in particular, not tapering to a point but have a free edge which extends obliquely or parallel to the tool axis.

With the reinforcing section provided according to the present invention in the edge region, advantageously in a comparatively highly effective way, a material concentration or a material accumulation, based on the overall extent of the frame, is performed in selected regions of the C-shaped frame. As compared with known C-shaped frames, in the C-shaped frame according to the present invention, the further C-shaped frame section that is present in the reinforcing section either manages with a comparatively lower material insert, can therefore be implemented so as to be slimmer or thinner transverse to the surface sides, or it is possible for further regions of the C-shaped frame to be saved, i.e. left out, by material-free regions.

In the limiting case or as a limiting design, it is possible that the complete C-shaped frame, if necessary, apart from comparatively small-area regions such as, for example, attachment sections for the punch unit, the die unit, lines and/or a C-shaped frame holder, such as an end of a robot arm, is formed substantially by the reinforcing section or with only comparatively small-area regions outside the reinforcing section.

It is not ruled out that the C-shaped frame is produced from sections integrally connected to one another, for example, by welding from steel parts.

For a design that is practical in the tool sector, a minimum length of a reinforcing section, in particular, of a portion, of about at least 30 millimeters and/or about at least 5% of the total length of the outer edge is to be used as a basis. Preferably, multiple such reinforcing sections and/or multiple such portions of a reinforcing section and/or multiple reinforcing sections are present. The reinforcing sections and/or the portions are either all immediately adjacent to one another, or two of the multiple reinforcing sections and/or two of the multiple portions are interrupted by a non-reinforced region. Accordingly, the multiple reinforcing sections and/or the multiple portions can be either provided immediately adjacent to one another or at a distance resulting from a non-reinforced intermediate section as compared with a minimum thickness of the C-shaped frame material.

At least approximately all of the outer edge can be reinforced in the same way and/or the reinforcing section is formed continuously over approximately all of the outer contour of the C-shaped frame, in particular, formed continuously uniformly, as regards the thickness and/or the width of the reinforcing section. Preferably, the reinforcing section and/or a portion has a thickness and/or width dimension changing, for example, continuously and/or, for example, stepwise in the profile of the outer edge, for example, matched to respectively differently high loadings in the tool insert in different regions of the C-shaped frame. Preferably, the width of the reinforcing section lies in the range between 5 mm and 150 mm.

For the optimal adaptation of the C-shaped frame, it is preferably such that the reinforcing section and/or a portion changes continuously and/or in the manner of a ledge in the direction and/or along the outer edge at one or at multiple points of the outer edge. For example, the reinforcing section and/or a portion changes in its thickness dimension and/or in its width dimension. For example, the reinforcing section and/or a portion changes in a direction normal to the surface sides and/or in an extent in the direction away from the edge, inward towards the surface sides. The reinforcing section and/or the portion accordingly has a physical extent with an extension direction in the direction of a thickness of the C-shaped frame, that is to say transversely and/or normally to the surface sides, and a width extent in the direction of the planes spanned by the surface sides.

A profile of an outer line of the outline of the C-shaped frame can be understood as an outer contour.

The mechanically reinforcing action of the reinforcing section is based, in particular, on an increase in the thickness of the material in the edge region as compared with an average thickness of the remaining regions of the surface sides. The area of the reinforcing section on a respective surface side, for example, based on this surface side, is preferably about 5% to about 10% of the total surface side under the assumption that material-free regions within the outer contour of the C-shaped frame also count toward the surface side.

Advantageously, the regions of the C-shaped frame remaining relative to the reinforcing section have a lower thickness than the reinforcing section, continuously or on average.

In addition, point-like, line-shaped or other small-area regions with an increased thickness possibly present in the non-edge region, such as, for example, ribs, studs and so on, generally mean that the remaining regions of the C-shaped frame nevertheless have a lower thickness on average than the reinforcing section.

Preferably, the reinforcing section is formed in coordination with the leg sections and the connection section in such a way that an elastic deformation behavior of the first leg section and an elastic deformation behavior of the second leg section is provided under a loading of the C-shaped frame which corresponds to a loading in cold-joining operation of the device. The predefinition of the elastic deformation behavior of the leg sections is, for example, such that with an elastic deformation of the leg sections, an offset between the punch axis and the tool axis and/or an offset of the die axis relative to the tool axis does not occur or is at least minimized. The deformation can be such that the physical position of the punch axis and the physical position of the die axis change in the same way in magnitude and/or direction, preferably change identically when the C-shaped frame is loaded during operation.

Given an offset that is minimized and can never be ruled out completely in practice, an angular offset between die and/or punch axis relative to the tool axis in the loaded state in the C-shaped frame according to the present invention preferably remains below an angle of 5°, preferably below an angle of 2°. The reinforcing section and the leg sections are matched in such a way that an angular and/or radial offset between the punch axis and the die axis and therefore between the punch axis and the tool axis, and between the die axis and the tool axis is minimized and, in the ideal case does not occur in a practically relevant manner or depending on the magnitude of the loading. A radial offset with parallel alignment of punch axis and die axis relative to one another remains below 3 millimeters, preferably below 1 millimeter.

It is advantageous if the reinforcing section is formed within an edge strip, wherein the edge strip extends from the outer edge as far as a surface-side section, wherein the surface-side section is spaced apart from the outer edge by at least 5 millimeters to a maximum of 150 millimeters.

Therefore, a width of the reinforcing section in the direction of sight at right angles to and based on the respective surface side of the C-shaped frame is predefined. As a rule, the width at the corresponding points is the same along the outer edge on both surface sides but can also differ.

The reinforcing section preferably reaches as far as the outer edge or forms the outer edge with its outer longitudinal side.

However, it is also possible that the reinforcing section reaches as far as the vicinity of the outer edge or is spaced slightly apart therefrom, for example, by a few millimeters. In the region of the spacing, the C-shaped frame then has a thickness that is reduced relative to the thickness of the reinforcing section, for example, a thickness corresponding to the thickness of the remaining surface side.

In other words, the C-shaped frame can have an outer border which is comparatively narrow and which is thinner and comparatively narrow relative to the reinforcing section and which, in terms of width, lies, for example, in the order of magnitude of the width of the reinforcing section, which border is provided on the outside, adjacent to the reinforcing section.

The reinforcing section advantageously has regions with a different but comparatively increased thickness, wherein the thickness dimensions are each greater than the average thickness of the remaining surface side. The reinforcing section can have, for example, a first thickness and a second thickness, not just based on its longitudinal extent but possibly also on its width, which are each formed, for example, over half the width of the reinforcing section. Both thicknesses are, for example, between twice and three times greater than the average thickness of the remaining C-shaped frame.

With the different thicknesses of the reinforcing section in the width direction and inward in the direction of the outer edge of the C-shaped frame, a reinforcing section which, for example, is ledge-like or changing continuously in thickness is set up.

A further advantage results from the fact that a thickness dimension of the reinforcing section of the C-shaped frame is greater than an average thickness dimension of the remaining part of the C-shaped frame. The thickness dimension results transversely to planes spanned by the surface sides or by a distance between a first outer side of the reinforcing section on the one surface side and an opposite second outer side of the reinforcing section on the other surface side. The remaining part of the C-shaped frame preferably has exactly one thickness dimension, is therefore uniform in its thickness over the entire extent. Individual or a few material-free regions or holes which may be present in the reinforcing section and in the remaining part of the C-shaped frame are not taken into account in determining the thickness dimension of the reinforcing section and the average thickness dimension, as though these were not present. For individual points with an increased thickness, this is calculated out on the basis of the average thickness dimension. Therefore, a few or individual or local points of the remaining part of the C-shaped frame according to the present invention can have a greater thickness than the thickness dimension of the reinforcing section. The reinforcing section preferably has multiple, in particular between two and six, portions in the direction of the longitudinal profile of the outer edge, each having a thickness dimension differing from the adjacent portion. The respective thickness dimensions are greater than the average thickness dimension of the remaining part of the C-shaped frame. It is also conceivable that two or more of the multiple portions which are not provided adjacent to one another over the length of the reinforcing section have the same increased thickness.

In principle, this does not rule out that at least an, in particular, comparatively short section of the outer edge has no increased thickness dimension as compared with the average thickness dimension of the remaining part of the C-shaped frame. Instead, it is a matter of the mechanical overall configuration between the outer edge or reinforcing section and the remaining part of the C-shaped frame.

In the thickness of the reinforcing section, it is accordingly possible for point-like, material-free points or other weakened points in the material, such as, for example, individual depressions or holes, to be present in the outer edge of the C-shaped frame which, as compared with the overall thickness and/or length of the edge reinforcement, are not important in practical terms and are therefore not taken into account in the thickness dimension determination. Such material weaknesses are not provided deliberately to save material but merely serve for other purposes or are possibly provided at individual points in the reinforcing section in order, for example, to attach additional components such as, for example, a cable to the C-shaped frame.

According to an advantageous modification of the present invention, the reinforcing section is formed over at least 80% of the length of the outer edge of the C-shaped frame, preferably formed over at least 90% of the length of the outer edge of the C-shaped frame.

Over the length of the outer edge, which, for example, can be provided closed in the manner of a loop which is based on the longitudinal direction of the outer edge, for example, an intermediate section can be provided which does not have a greater thickness dimension or is configured in accordance, for example, with the average thickness dimension of the remaining part of the C-shaped frame, for example, in the manner of a short gap or interruption of the reinforcing section.

The shape of the profile of the reinforcing section, as viewed over the outer edge length, can be flexible. This relates both to the transitions between the portions of different thickness and to the shape over the length of a viewed portion itself.

The transitions between the portions of different thickness dimension can, for example, be continuous or discontinuous or abrupt.

The reinforcing section preferably has respective flat level upper and outer sides on both surface sides as a constituent part of the surface sides.

According to another advantage of the present invention, the reinforcing section has a thickness dimension which is at least twice as great as the average thickness dimension of the remaining part of the C-shaped frame. Preferably, the reinforcing section has a thickness dimension which is 2.5 to 5 times as great as the average thickness dimension of the remaining part of the C-shaped frame. The C-shaped frame is advantageously designed therewith with regard to its mechanical behavior.

It is further advantageous if the reinforcing section has a thickness dimension which is more than about 300% greater than the average thickness dimension of the remaining part of the C-shaped frame. The excess thickness preferably lies in the range between 100% and 500%, based on the average thickness of the remaining C-shaped frame, for example, at around 300%, based on the average thickness of the remaining C-shaped frame. This, therefore, advantageously takes into account factors such as overall stiffness, total weight, mass distribution and/or deformation behavior of the C-shaped frame.

Advantageously, the C-shaped frame has an overall frame height which results from the distance between a free end of a leg at a point of the outer edge of the C-shaped frame in the direction of the longitudinal axis of the leg and at right angles to a tool axis that can be provided on the C-shaped frame. The overall frame height is between 25 cm to about 50 to 200 cm, for example, depending on the application.

In this connection, it is advantageous that the reinforcing section relates to an edge region which is further removed from the tool axis than a parallel to the tool axis that can be provided on the C-shaped frame, wherein the parallel predefines 20% of the frame height.

Preferably, the reinforcing section is provided over an at least substantial length along the outer edge on the connection section of the C-shaped frame, preferably over the entire outer edge on the connection section of the C-shaped frame.

A preferred refinement of the present invention is distinguished by the fact that the thickness dimension of the reinforcing section lies between 30 millimeters and 150 millimeters. A reinforcing section that is more advantageous in practice is formed thereby.

Advantageously, a cross-sectional area of the reinforcing section is between 500 $mm^2$ and 7000 $mm^2$. This relates to a respectively viewed point along the outer edge or to an average cross-sectional area. The cross section is understood to be a section transverse to the longitudinal extent of the profile along or in the direction of the outer edge.

An average cross-sectional area over the entire length or extent of the reinforcing section results in the case of two or more differently strongly formed sections of the reinforcing section, the proportions of the length of the respective reinforcing sections being taken into account.

A further advantageous embodiment of the present invention consists in the first leg section comprising two first beam sections, which are separated from one another by a first weakening section in the first leg section. This provides an optimized configuration of the C-shaped frame, in particular, from mechanical and production points of view. In particular, a material-saving design and weight-optimized configuration is achieved as compared with a C-shaped frame without a weakening section. Material weakening such as, for example, a material cutout or a through hole or material-free window in the surface side, firstly brings a saving in material and weight and secondly a reduction in stability. With the reduction in stability, it is additionally possible to purposefully influence or exactly predefine an elastic behavior of the respective leg section or its beam sections via the size, shape and/or positioning of the material cutout on the C-shaped frame. This is advantageous with regard to the minimization of the radial offset and the angular offset of the punch unit and the die unit relative to the ideal alignment that occurs under load.

The weakening section and therefore the beam sections are advantageously designed such that the deformation of the beam sections is predefined. The beam sections are advantageously comparatively considerably stiffer in its longitudinal direction, that is to say against tension and compression, than against bending under lateral load. The opposite or facing beam sections of the two leg sections are deformed under load such that they are each deformed inward or toward the weakening section. The two outer beam sections, on the other hand, are deformed to an extent that is comparatively lower and not relevant in practice. This achieves the situation in which an angular deviation both of the axis of the punch unit and of the axis of the die unit relative to the tool or joining axis advantageously does not take place or takes place only to a minimum or tolerable extent. This is achieved by the design and matching of the weakening sections and the beam sections of the two leg sections, which adjoin the respective weakening section laterally and on both sides. The two beam sections of the two leg sections preferably each have a reinforcing section in the edge with an increased thickness dimension.

For both leg sections, it is true that the inner beam section extends preferably at least substantially rectilinearly in its longitudinal direction transverse to the tool axis or is indented inward toward the weakening section or bent slightly inward, that is to say is shaped concavely in a view directed from the outside onto the narrow side or the outer edge of the C-shaped frame.

For both leg sections, it is true that the outer beam section is preferably at least substantially rectilinear in its longitudinal direction transverse to the tool axis or comprises several rectilinear sections that are at an angle to one another or is curved outward, that is to say is shaped convexly in a view directed from the outside onto the narrow side or the outer edge of the C-shaped frame.

Therefore, the beam sections are deformed predefinably elastically under load such that the punch unit and the die unit attached to the ends of the beam sections move at least virtually parallel and along the tool axis and not tilt or skew somewhat relative to the tool axis—or only to a tolerable extent.

In known C-shaped frames without reinforcing sections and/or without a material cutout in the leg sections, for example, with massive or two-dimensional enclosed leg sections, opposite ends of the two leg sections bending open, and therefore tilting of the punch unit and die unit takes place to a frequently not tolerable or disadvantageous extent, so that an undesired angular offset of the punch axis and/or the die axis relative to the tool axis occurs, which is not desired. The C-shaped frame according to the present invention avoids the aforementioned disadvantages of the known C-shaped frame.

A weakening section in the C-shaped frame can be a material cutout or a perforated region or a material-free region. The weakening section in the C-shaped frame can, however, also be a comparatively highly weakened region in the material thickness, compared with a remaining part of the C-shaped frame without the reinforcing section. The weakening section can accordingly be comparatively thin or have a comparatively low material thickness of, for example, 5-20% of the average thickness of the remaining regions of the C-shaped frame relative to the reinforcing section, for example, between one and a few millimeters, for example, can be formed as a thin metal sheet. As compared with the adjacent sections of the remaining part of the C-shaped frame, the weakening section can also be partly or entirely filled with a material that can be loaded mechanically considerably less as compared with the material of the remaining part of the C-shaped frame, such as a plastic material or, for example, a foam material or filling material.

Preferably, an area of the surface side of the C-shaped frame which spans between the two first beam sections of the first leg section is substantially formed by the weakening section. Preferably, from an overall area between the two first beam sections, about 70 to 90% is formed by the weakening section, that is to say formed in particular by a material opening or a material window. Over its predominant length, the edge of the weakening section follows the outer contour or the outer edge of the C-shaped frame or the outer edge in the region of the two first beam sections, which edge is preferably formed as a reinforcing section.

It is additionally advantageous if the second leg section comprises two second beam sections, which are separated from one another by a second weakening section in the second leg section. Here, that stated in relation to the first weakening section and the first leg section applies correspondingly.

Preferably, the two first and the two second leg sections are matched to the respective two beam sections in such a way that both leg sections deform in a matching fashion, so that the physical position of the punch axis and the physical position of the die axis change in the same way in magnitude and/or direction, preferably change identically when the C-shaped frame is loaded during operation.

Preferably, the first and the second leg section has exactly one weakening section.

According to an advantageously configured C-shaped frame, the connection section preferably has exactly one weakening section. The weakening section in the connection section is preferably provided adjacent to a part of the outer edge of the C-shaped frame or the connection section, wherein the edges of the two inner beam sections of the first and second leg section are connected to one another via the relevant part of the outer edge. In the weakening section, an attachment point can project, which is used to attach the C-shaped frame to a movement unit or to a bracket for connection to a robot arm for moving the C-shaped frame during useful use, for example, having screw holes for screwing the C-shaped frame to the robot arm.

The C-shaped frame preferably has three weakening sections, which are formed relative to one another in the same order of magnitude as regards the area of the weakening sections. The weakening sections have an approximately triangular outline, preferably having respectively rounded corner regions.

The present invention also extends to a device for cold joining, in particular, to a cold-joining tool, wherein the device has a C-shaped frame according to one of the previously described refinements, wherein a punch unit of the device is provided at a free end of a first leg section, and a die unit of the device is provided at a free end of a second leg section. The punch unit and the die unit are preferably detachably yet firmly replaceable and attachable to the C-shaped frame. The cold-joining device is preferably implemented as a robot-guided tool, for example, a tool for riveting or solid punch riveting or semi-tubular punch riveting, for clinching, for pressing-in or for embossing.

Finally, it is advantageous that a drive unit that can be assigned to the punch unit and/or the die unit is provided, wherein the drive unit comprises a hydro-pneumatic drive with pressure boost and/or an electric drive.

By using the drive unit, which effects a relative movement between a punch of the punch unit and the die unit, the work of the cold-joining device is carried out. Forces and torques which occur are absorbed by the C-shaped frame. With the reinforcing section of the C-shaped frame, undesired elastic deformation of the C-shaped frame under useful loading can advantageously be minimized. This is necessary for the success of the cold-joining process. By using the arrangement according to the present invention, riveted connections, clinched connections or other cold-joining processes can advantageously be carried out.

BRIEF DESCRIPTION OF THE DRAWINGS

Further features and advantages of the present invention are explained by using arrangements according to the invention illustrated schematically in the figures.

DETAILED DESCRIPTION OF THE INVENTION

Figure 1:
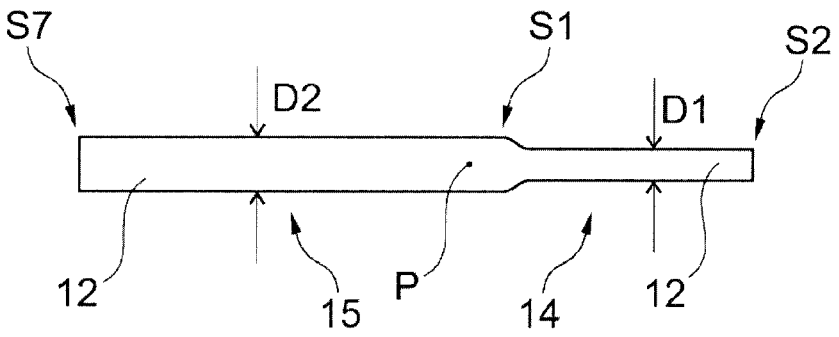
FIG. 1 shows a C-shaped frame according to the present invention in a view of a narrow side of the C-shaped frame facing away from the tool.

A C-shaped frame 1 according to the present invention for a cold-joining tool according to FIGS. 1-4 is preferably formed in one piece and, for example, produced from a plate material blank, preferably from a steel material, for example, machined out. The C-shaped frame 1 comprises two leg sections 2 and 3 spaced apart from one another and a connection section 4.

A free end 5 of the first leg section 2 is designed to detachably but firmly hold a punch unit 6 (see FIG. 5) of the associated cold-joining tool. A free end 7 of the second leg section 3 is designed to detachably but firmly hold a die unit 8 of the associated cold-joining tool. In the C-shaped frame 1 equipped for the tool use with the punch unit 6 and die unit 8 held thereon according to FIG. 5, the punch unit 6 and the die unit 8 are located opposite one another and predefine a tool axis W of the associated cold-joining tool.

An approximately C-shaped or U-shaped outer contour 11 of the C-shaped frame 1 is determined by an outer edge 12 of the C-shaped frame 1. The outer contour 11 is formed in accordance with an outer peripheral narrow side of the C-shaped frame 1 in the transition between two surface sides 9 and 10 of the C-shaped frame 1. In the region reaching as far as the outer edge 12 or in the near region of the outer edge 12, a reinforcing section 13 of the C-shaped frame 1 having a respective thickness D1 or D2 is formed. The outer contour 11 and, therefore, the outer edge 12 have different points S1 to S7 following one another in the counterclockwise direction, based on the top view of the surface side 9 according to FIG. 2. The basis here is that the point S3 coincides with the free end 7 and the point S6 coincides with the free end 5.

Figure 2:
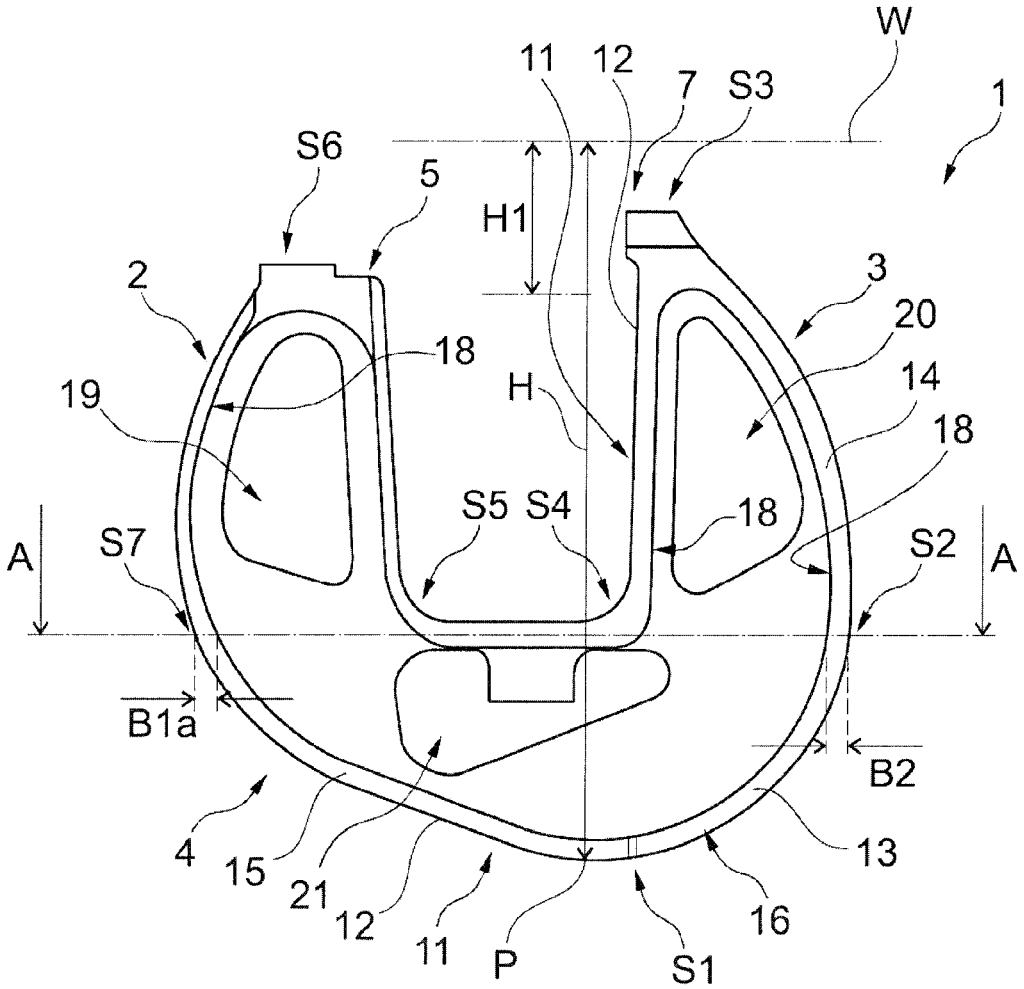
FIG. 2 shows the C-shaped frame from FIG. 1 in a view of a surface side of the C-shaped frame.

According to FIG. 2, viewed in the counterclockwise direction along the outer contour 11, the first leg section 2 is bordered by the outer edge 12 between the points S5 and S7. The second leg section 3 is bordered by the outer edge 12 between the points S2 and S4. The connection section 4, viewed in the counterclockwise direction along the outer contour 11, is accordingly bordered by the remaining part of the outer edge 12 between the points S7 and S2 and, relative to the leg sections 2 and 3, is bounded by the line A-A, which extends through the points S2 and S7. The two leg sections 2 and 3 are spaced apart by the part of the outer edge 12 between the points S4 and S5, wherein this part of the outer edge 12 bounds an edge section of the connection section 4.

The ends of the leg sections 2 and 3 facing away from the free ends 5 and 7 on the line A-A between the points S7 and S5 in the leg section 2 and on the line A-A between the points S4 and S2 in the leg section 3, are connected to one another via the connection section 4. The connection section 4 reaches as far as the virtual line A-A illustrated in FIG. 2 and is bounded by the latter. The line A-A extends parallel to and offset from the tool axis W.

The first surface side 9 of the C-shaped frame 1 is illustrated in top view in FIG. 2, wherein the second surface side 10 is opposite the first surface side 9. The C-shaped frame 1 comprises the reinforcing section 13, which is present on the outer edge 12 along the outer contour 11 of the C-shaped frame 1. Viewed over a profile of the reinforcing section 13 along the outer edge, the reinforcing section 13 has a plurality of portions, at least two here, each having an associated thickness transverse to the surface sides 9, 10. In the example of the C-shaped frame 1 illustrated, the reinforcing section 13 has two portions 14 and 15. Starting from the view according to FIG. 2 and in the counterclockwise direction along the outer contour 11, the portion 14 reaches from the points S1 via S2 and S3 as far as the point S4 with an associated constant or uniform thickness dimension D1 of the portion 14. The transition between the two portions 14 and 15 and from the thickness D1 to the thickness D2 is preferably formed with a concave taper, which in particular can be seen at the point S1 in FIG. 1.

The second portion 15 accordingly reaches from the point S4 via S5, S6 and S7 as far as the point S1 with an associated constant or uniform thickness dimension D2. The thickness D1 is approximately 70% of the thickness D2.

The reinforcing section 13, based on the two surface sides 9 and 10, is formed within an edge strip 16 or 17 and an inner boundary of the reinforcing section 13 coincides with the inner edge of the edge strips 16, 17. The edge strip 16 forms a loop-like outer peripheral part of the first surface side 9, and the edge strip 17 forms a part of the second surface side 10. The two edge strips 16 and 17 are opposite one another and, by way of example, are identical in their width B1 and B2. The reinforcing section 13 can alternatively have a different width on the surface side 9 than on the surface side 10.

In the C-shaped frame 1, the width of the reinforcing section 13 or the width B1, B2 of the portions 14 and 15 is not constant; instead this width changes over the length of the relevant portion 14 and 15 along the outer edge with a respective unchanged thickness D1 and D2 here by way of example.

Within the surface side 9 and 10, the edge strip 16 and 17 having the reinforcing section 13 extends from the outer edge 12 as far as a line 18, wherein the line 18 is spaced apart from the outer edge 12 by at least 5 millimeters to at most 150 millimeters, which predefines a value range for a maximum value of the width B1 and B2.

The surface sides 9, 10, apart from the edge-side reinforcing section 13 and the free ends 5 and 7, are flat and level. Preferably, the planes respectively spanned by the surface sides 9 and 10 are aligned parallel to one another.

Figure 3:
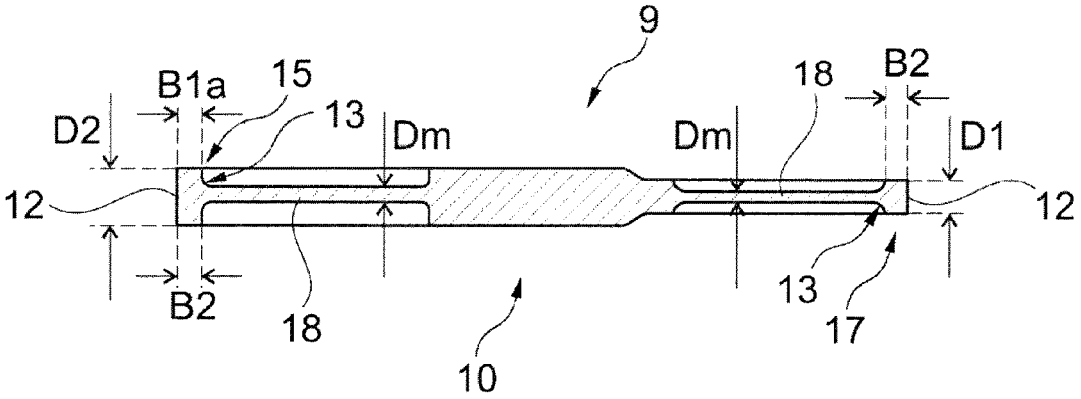
FIG. 3 shows the C-shaped frame in section according to the line A-A in FIG. 2.
Figure 4:
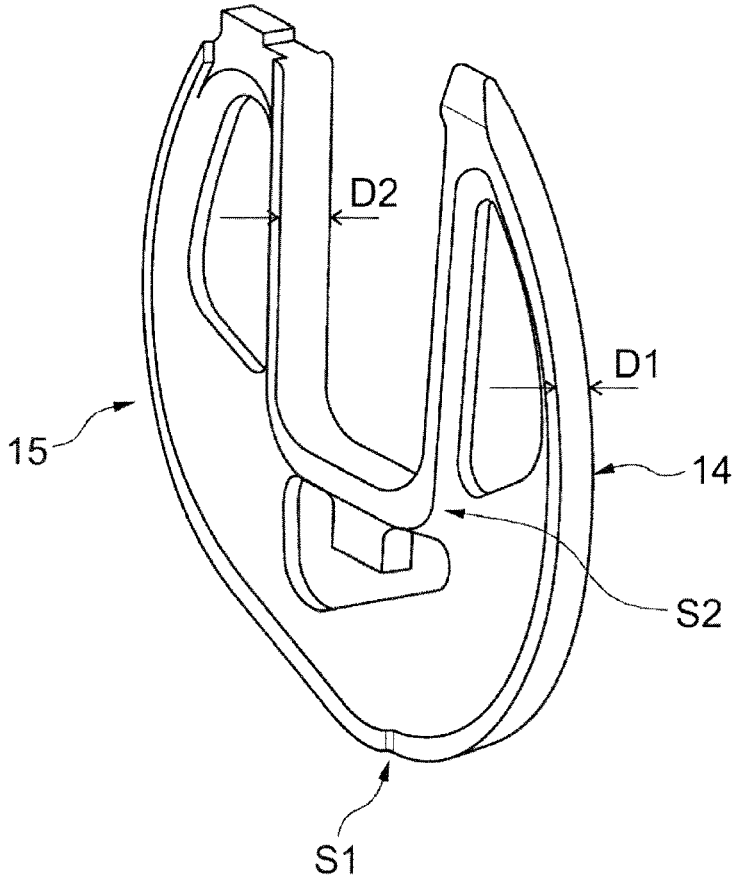
FIG. 4 shows the C-shaped frame according to FIGS. 1-3 in a perspective view.

The thickness D1 and D2 of the reinforcing section 13 is greater than an average thickness dimension Dm of the remaining part of the C-shaped frame 1 (see FIG. 3).

The reinforcing section 13 is formed over virtually the whole length of the outer edge 12 of the C-shaped frame 1. Only in the region of the free ends 5 and 7 is the outer edge 12 of the C-shaped frame 1 adapted for the detachable attachment of the punch unit 6 and the die unit 8. Therefore, over a comparatively short section at the free ends 5 and 7, the outer edge 12 can have a normal thickness or a lower thickness than the thickness D1 or D2 of the reinforcing section 13.

The C-shaped frame 1 has an overall frame height H, which from the distance between the tool axis W that can be provided on the C-shaped frame 1 and a point P of a center line of the outer edge 12 of the C-shaped frame 1, wherein the point P lies on a central plane centrally between those spanned by the two surface sides 9, 10, in which the tool axis W also lies.

The reinforcing section 13 is formed on the C-shaped frame 1, preferably at least over the part on the outer edge 12 which, in the vertical direction of the C-shaped frame 1 from the tool axis W, is located on the other side of a vertical line parallel to the tool axis W, wherein the vertical line corresponds to a partial height H1, which makes up 20% of the total height H (see FIG. 2). This means that part of the leg sections 2, 3 is formed in the region of the free ends 5, 7 without any reinforcing section 13, which is due to the attachment of the punch unit and die unit 6, 8.

The C-shaped frame 1 has a weakening section 19 in the first leg section 2 and a weakening section 20 in the second leg section 3 and a further weakening section 21 in the connection section 4. The weakening sections 19-21, each formed as a material-free region or as a material cutout or opening, permit a saving in material and therefore in weight of the C-shaped frame 1 with no detrimental effect that is relevant in practice with regard to the mechanical stability values of the C-shaped frame 1 according to the present invention in useful tool use. The reduced stability associated with the weakening sections 19-20 is at least compensated by the reinforcing section or an additional advantageous property of a predefinable elasticity behavior of the C-shaped frame and of the leg sections in the useful use of the tool formed thereby is achieved.

The weakening sections 19 and 20 result in a structure of the two leg sections 2 and 3 each having two beam sections 22, 23 and 24, 25.

Thus, the first leg section 2 has two first beam sections 22 and 23, and the second leg section 3 has two second beam sections 24 and 25.

The weakening sections 19-21 do not reach as far as into the reinforcing section 13. The weakening sections 19-21 predominantly have a spacing relative to the reinforcing section 13. Only the weakening section 21 adjoins the reinforcing section 13 over short distances between the points S4 and S5.

Provided on the reinforcing section 13, between the points S4 and S5, is an attachment point 26 such as, for example, a flat flange section 27, for example, for the connection to a robot arm.

Figure 5:
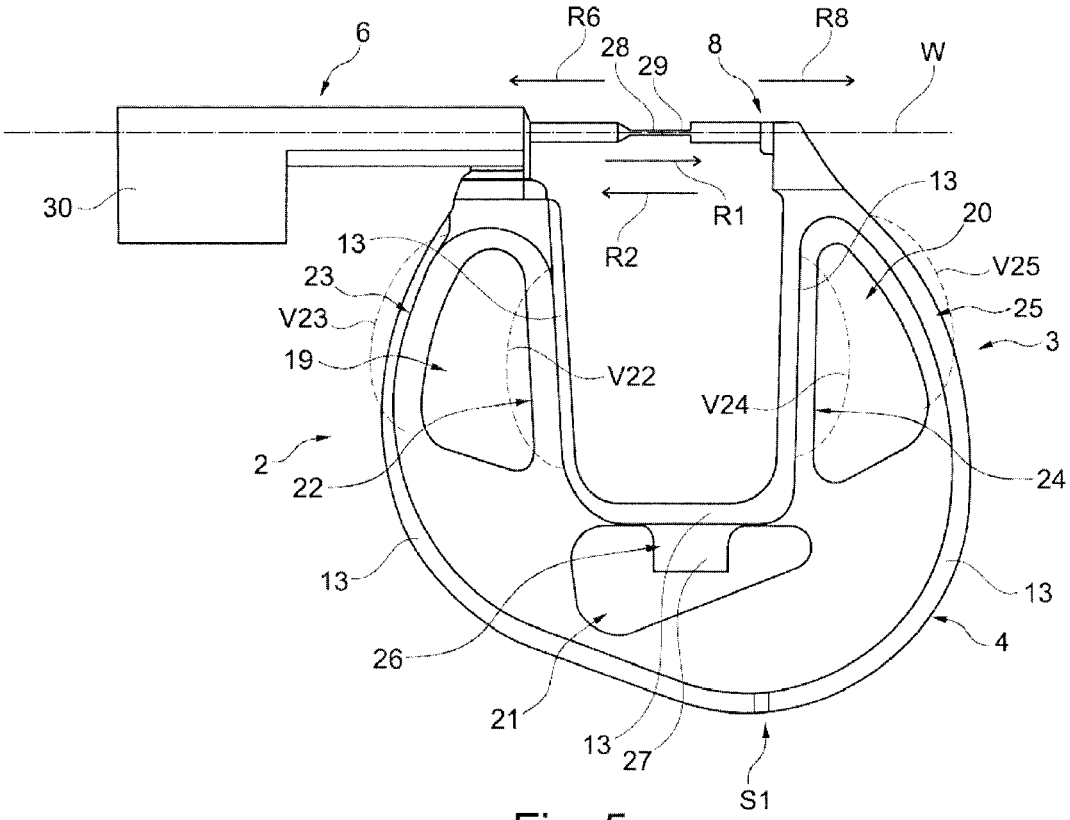
FIG. 5 shows the C-shaped frame according to FIGS. 1-4, on which a punch unit and a die unit are accommodated.

FIG. 5 shows, on the C-shaped frame 1 for use in a cold-joining tool, the punch unit 6 having a punch element 28, which can be driven reversibly and linearly in the direction R1 and R2 by a drive unit 30. The die unit 8 having a die element 29 is provided opposite. A workpiece that can be processed by the cold-joining tool, such as two or more sheet metal layers, which can be clamped between a free end of the punch element 28 and the die element 29 in order to be processed, is not illustrated in FIG. 5.

In FIG. 5, the elastic deformation behavior of the C-shaped frame 1 equipped with the punch unit and die unit 6, 8 is indicated in practical tool operation, for example, during a riveting or clinching process.

With loading of the C-shaped frame 1 with the tool working, the two leg sections 2 and 3 or their respective beam sections 22, 23 and 24, 25 deform in such a way that a bending-open effect of the C-shaped frame 1 and the leg sections 2, 3 does not detrimentally occur in practice.

The deformation of the beam sections 22-25 is indicated highly schematically and unrealistically to an exaggerated extent with dashed lines in FIG. 5. The deformation V22 for the deformation of the beam section 22, the deformation V23 for the deformation of the beam section 23, the deformation V24 for the deformation of the beam section 24 and the deformation V25 for the deformation of the beam section 25.

As a result of the deformations V22 to V25, which are substantially determined by the formation and mutual matching of the weakening sections 19, 20 and 21 and the reinforcing section 13, the beam sections 22-25 bend such that a tool offset and skewing or an axial offset is advantageously lower than in known C-shaped frames during tool use. An absolute deformation of the leg sections 2, 3 in the direction of the force or along the tool axis W can be comparatively greater in the C-shaped frame 1 according to the present invention during tool use than in known arrangements, but this is not critical or can be compensated by a somewhat longer driven movement path of the punch element 28.

Because of the indicated deformations V22-V25 of the beam sections 22-25, during tool use the punch unit 6 and therefore the punch element 28, as a rule superimposed on the driven movement of the punch element 28 in the direction R1 or R2, move virtually linearly and parallel to the tool axis W in the direction R6 and back again counter to R6, without any practically relevant skewing of the longitudinal axis of the punch element 28 relative to the tool axis W.

In a corresponding way, during tool use the die unit 8 and, therefore, the die element 29, in the direction R8 and back again counter to R8, move virtually linearly and parallel to the tool axis W without any practically relevant skewing of the longitudinal axis of the die element 29 relative to the tool axis W.

The deformations V2 of the inner beam section 22 and the deformation V24 of the inner beam section 24 are, for example, curved concavely inward toward the weakening section 19 and toward the weakening section 20 in relation to the unloaded state according to FIG. 2. A corresponding deformation or bulging in the same direction is exhibited by the outer beam section 23 of the first leg section 2 and the outer beam section 25 of the second leg section 3, that is to say bulging outward.

In known C-shaped frames, in particular of uniformly plate-like design without weakening sections in particular deliberately formed to this effect, the leg sections deform precisely differently with an inwardly curved or an inwardly convex bulging of inner narrow sides of leg sections of the known frame.

LIST OF DESIGNATIONS

1 C-shaped frame
2 Leg section
3 Leg section
4 Connection section
5 End
6 Punch unit
7 End
8 Die unit
9 Surface side
10 Surface side
11 Outer contour
12 Outer edge
13 Reinforcing section
14 Portion
15 Portion
16 Edge strip
17 Edge strip
18 Line
19 Weakening section
20 Weakening section
21 Weakening section
22 Beam section
23 Beam section
24 Beam section
25 Beam section
26 Attachment point
27 Flange section
28 Punch element
29 Die element
30 Drive unit

The invention claimed is:

1. A C-shaped frame for a cold joining device, the C-shaped frame comprising:

a first leg section and a second leg section, wherein the first and second leg sections are spaced apart from one another; and a connection section having at least one weakening section formed therein, wherein a free end of the first leg section is adapted to receive a punch unit of the cold joining device, and a free end of the second leg section is adapted to receive a die unit of the cold joining device, whereby the punch unit and the die unit are located opposite one another and define a tool axis, wherein ends of the leg sections that face away from the free ends are connected to one another via the connection section, wherein the C-shaped frame further comprises a first surface side and a second surface side opposite the first surface side, wherein an outer contour of the C-shaped frame is defined by an outer edge of the C-shaped frame in a transition between the first and second surface sides, wherein the C-shaped frame further comprises a reinforcing section provided on the outer edge of the C-shaped frame along the outer contour of the C-shaped frame, wherein multiple portions of the reinforcing section each have an associated thickness dimension over a longitudinal profile of the reinforcing section, as seen along the outer edge, wherein the thickness dimension of 2 to 6 of the multiple portions of the reinforcing section each differs from the thickness dimension of adjacent ones of the multiple portions of the reinforcing section in a direction of the longitudinal profile of the outer edge, wherein an extent of respective portions along the outer edge and parallel to a surface side in each case is at least 30 millimeters, and wherein an attachment part, comprising a flat flange for connecting the C-shaped frame to a robot arm, is located on a portion of the reinforcing section between the two leg sections, and extends into a central one of the at least one weakening section.

2. The C-shaped frame as claimed in claim 1, wherein the reinforcing section is formed within an edge strip, wherein the edge strip extends from the outer edge as far as a surface-side section, and wherein the surface-side section is spaced apart from the outer edge by at least 5 millimeters to a maximum of 150 millimeters.

3. The C-shaped frame as claimed in claim 1, wherein a thickness dimension of the reinforcing section of the C-shaped frame is greater than an average thickness dimension of the remaining part of the C-shaped frame.

4. The C-shaped frame as claimed in claim 1, wherein the reinforcing section is formed over at least 80% of a length of the outer edge of the C-shaped frame.

5. The C-shaped frame as claimed in claim 4, wherein the reinforcing section is formed over at least 90% of the length of the outer edge of the C-shaped frame.

6. The C-shaped frame as claimed in claim 1, wherein the reinforcing section has a thickness dimension that is at least twice as great as an average thickness dimension of a remaining part of the C-shaped frame.

7. The C-shaped frame as claimed in claim 1, wherein the reinforcing section has a thickness dimension that is more than 300% greater than an average thickness dimension of a remaining part of the C-shaped frame.

8. The C-shaped frame as claimed in claim 1, wherein the C-shaped frame has an overall frame height measured from the free end of a leg section at a point on the outer edge of the C-shaped frame in a direction of a longitudinal axis of the leg section and at right angles to the tool axis.

9. The C-shaped frame as claimed in claim 1, wherein the reinforcing section has an edge region that is offset from being parallel to the tool axis, and which defines 20% of a frame height.

10. The C-shaped frame as claimed in claim 1, wherein a thickness dimension of the reinforcing section is in a range of 30 millimeters to 150 millimeters.

11. The C-shaped frame as claimed in claim 1, wherein a cross-sectional area of the reinforcing section is in a range of 500 $mm^2$ to 7000 $mm^2$.

12. The C-shaped frame as claimed in claim 1, wherein the first leg section comprises two first beam sections, which are separated from one another by a first weakening section in the first leg section.

13. The C-shaped frame as claimed in claim 1, wherein the second leg section comprises two second beam sections, which are separated from one another by a second weakening section in the second leg section.

14. A cold joining device comprising the C-shaped frame as claimed in claim 1, wherein a punch unit of the cold joining device is provided at the free end of the first leg section, and wherein a die unit of the device is provided at the free end of the second leg section.

15. The cold joining device as claimed in claim 14, further comprising a drive unit assigned to at least one of the punch unit and the die unit, wherein the drive unit comprises a hydro-pneumatic drive with pressure boost and/or an electric drive.

* * * * *